US012319462B2

(12) United States Patent
Ilgenfritz et al.

(10) Patent No.: US 12,319,462 B2
(45) Date of Patent: Jun. 3, 2025

(54) DEVICE, SET, PHARMACEUTICAL PLANT AND METHOD FOR UNPACKING A PLURALITY OF ARTICLES

(71) Applicant: Syntegon Technology GmbH, Waiblingen (DE)

(72) Inventors: Markus Ilgenfritz, Feuchtwangen (DE); Ulrich Krauß, Ilshofen (DE); Stefan Nagler, Unterschneidheim (DE); Florian Schmidl, Dinkelsbühl (DE)

(73) Assignee: Syntegon Technology GmbH, Waiblingen (DE)

( * ) Notice: Subject to any disclaimer, the term of this patent is extended or adjusted under 35 U.S.C. 154(b) by 182 days.

(21) Appl. No.: 18/296,191

(22) Filed: Apr. 5, 2023

(65) Prior Publication Data

US 2023/0339641 A1 Oct. 26, 2023

(30) Foreign Application Priority Data

Apr. 26, 2022 (DE) ..... 10 2022 110 051.0

(51) Int. Cl.
*B65B 69/00* (2006.01)

(52) U.S. Cl.
CPC ..... *B65B 69/0033* (2013.01)

(58) Field of Classification Search
CPC ..... B65B 69/00; B65B 69/0033
See application file for complete search history.

(56) References Cited

U.S. PATENT DOCUMENTS 4,245,946 A * 1/1981 McCullough ..... B65B 69/00 414/412
4,580,938 A * 4/1986 Mojden ..... B65G 59/026 414/412
4,681,507 A * 7/1987 Mojden ..... B65B 69/0033 414/412
5,375,961 A * 12/1994 Mojden ..... B65B 69/00 414/416.11
5,743,313 A * 4/1998 Josefsson ..... B65B 69/0075 141/330
8,567,293 B2 * 10/2013 Freudenberg ..... B65B 69/0025 83/17
2011/0100175 A1 * 5/2011 Freudenberg ..... B65B 69/0025 83/29
2021/0292032 A1 * 9/2021 Trebbi ..... B65B 69/0058

FOREIGN PATENT DOCUMENTS

DE 4236865 A1 * 5/1994 ..... B65B 69/0033
DE 102008032368 A1 1/2010
JP S5841030 A * 3/1983 ..... B65B 69/00
JP 2015209219 A 11/2015
WO WO-2018019874 A1 * 2/2018 ..... B65B 69/0008

OTHER PUBLICATIONS

European Search Report for Application No. 23158380.8 dated Oct. 19, 2023 (12 pages. including English translation).
German Patent Office Action for Related Application No. 102022110051.0 dated Dec. 22, 2022 (6 pages, including an English statement of relevance).

* cited by examiner

*Primary Examiner* — Andrew M Tecco
(74) *Attorney, Agent, or Firm* — Michael Best & Friedrich LLP

(57) ABSTRACT

Disclosed are a device and a method for unpacking a plurality of articles arranged in an elongated package having an upper end and a lower end stacked one on top of the other in an elongated stack.

12 Claims, 4 Drawing Sheets

DEVICE, SET, PHARMACEUTICAL PLANT AND METHOD FOR UNPACKING A PLURALITY OF ARTICLES

BACKGROUND

The invention relates to a device for unpacking a plurality of articles, in particular pre-sterilized articles, a set, a pharmaceutical plant, and a method for unpacking a plurality of articles, in particular pre-sterilized articles.

For microbiological monitoring in e.g. a pharmaceutical production machine, Petri dishes and/or swab samples are often used. These are plastic dishes filled with nutrient medium (agar) and fitted with a lid. Petri dishes are used for monitoring the air, and swab samples are used for monitoring surfaces. Petri dishes and swab samples are usually stacked on top of each other in stacks of 10 and packed in three sterile foil bags. The two outer bags are removed step by step when the Petri dishes or the swab samples are transferred from the uncontrolled room into the pharmaceutical production machine.

Before the start of production, the innermost bag is cut open manually, e.g. with scissors, by an operator who uses gloves to access the production machine. The Petri dishes or swab samples can then also be removed manually and placed in a storage magazine, for example. They remain there until they are needed for monitoring.

Before the innermost bag is opened (manually), it is decontaminated in a decontamination process within the production machine so that it is germ-free.

Another option is to manually open the bag containing the Petri dishes or the swab samples in a separate isolator (additional isolator to the pharmaceutical production machine) via glove port in the isolator. Subsequently, the Petri dishes or swab samples can be manually sorted into a magazine, which is then fed into the actual production machine via a sterile beta container or via a connecting door. The magazine can be removed from the container by a handling device and placed in the pharmaceutical production machine.

Here, too, the innermost bag is decontaminated in a decontamination process inside the separate isolator before (manual) opening, so that it is germ-free.

The disadvantage of this is that to open the bag containing the Petri dishes or the swab samples in the production machine, glove port is required for manual unpacking or, in addition to the production machine, a separate isolator with glove port is required.

SUMMARY

It is therefore the task of the invention to provide a device, a set, a pharmaceutical plant and a method, whereby the above disadvantages are eliminated and, in particular, an automated unpacking of the Petri dishes or swab samples is made possible.

This task is solved by a device for unpacking a plurality of articles, in particular pre-sterilized articles, arranged in an elongated package with an upper end and a lower end stacked on top of each other in an elongated stack, within a pharmaceutical plant, in particular within a clean room, in particular within an isolator, according to the invention.

The articles may be Petri dishes or swab samples. The package may be in the form of a bag or a tubular bag package, particularly tubular. The lower end of the package may be formed as a lower flap of the package. The upper end of the package may be formed as an upper flap of the package. The upper end of the package may be a (upper) portion of the package. The lower end of the package may be a (lower) portion of the package.

The device includes at least one lower stop for the articles, onto which the stack of articles in the package can be placed at one or more locations distributed around the circumference of the package. The lower stop may be in the form of a receptacle or receiving plate for receiving the package together with the articles disposed therein. The device may include one or more lower stops.

The device further comprises at least one lower fixing device. The lower fixing device is arranged below the lower stop. The lower stop comprises a passage, in particular a central passage, through which the lower end of the package can extend below the lower stop (when the articles are in contact with the lower stop), so that the lower end of the package can be gripped by the inner fixing device while the articles in the package are resting against the lower stop. The device may include one or more lower fixing devices.

The passage can be in the form of a circumferentially closed opening or partially open, for example to the side. The lower fixing device can be designed to fix (clamp) or grip the lower end of the package, in particular in a clamping manner.

The device further comprises at least one upper fixing device. The upper fixing device is arranged above the upper stop. The upper fixing device is designed for gripping the upper end of the package while the articles in the package are resting against the lower stop. The upper fixing device may be configured to fix (clamp) or grip the upper end of the package, in particular in a clamping manner. The upper fixing device may be formed analogously, in particular identically, to the lower fixing device. The device may comprise one or more upper fixing devices.

The device further comprises at least one cutting device for cutting open (or cutting off) one of the ends (the upper end or the lower end) of the package while the articles in the package are resting against the lower stop. The device may comprise one or more cutting devices.

The cutting device can have at least one horizontally movable knife. The knife can be designed as a linearly movable rolling knife. The knife can also be designed as a straight knife which carries out the cutting process with a rotating or pivoting movement.

The cutting device can be arranged above or below the lower stop. The cutting device can be arranged between the lower stop and the lower fixing device. The cutting device can also be arranged between the lower stop and the upper fixing device.

The fixing device (the lower or the upper one) arranged at the end (the lower or the upper one) of the package opposite the cutting device while the articles in the package are resting against the lower stop is designed as a removal device. The removal device is adapted to pull off (remove) the package opened (cut open) by the cutting device from the stack of articles.

The lower end may be formed as a first end and the upper end may be formed as a second end of the package. The lower fixing device may be formed as a first fixing device and the upper fixing device may be formed as a second fixing device. The lower stop may be formed as a first stop.

The cutting device and the lower fixing device can be arranged below the lower stop, and the upper fixing device designed as a removal device can be arranged above the lower stop. In this way, the lower end (or the lower flap) of the package can be cut open or cut off and the cut open package can be pulled away (or removed) from the articles by means of the removal device in an upward direction, in particular in a direction opposite to the direction of gravity.

It is also conceivable that the cutting device and the upper fixing device can be arranged above the lower stop and the lower fixing device designed as a removal device can be arranged below the lower stop. In this way, the upper end (or the upper flap) of the package can be cut open or cut off and the cut open package can be pulled away downwards from the articles, in particular in the direction of gravity, by means of the removal device.

The placement (positioning) of the package together with the articles contained therein in the pharmaceutical plant, in particular in the clean room, especially in the isolator, can be carried out manually by an operator or automatically by means of a handling device. (e.g. robot arm).

In the present case, the terms such as "downwards", "lower", "below" or "upwards", "upper", "above" refer to gravity or the direction of gravity. For example, the lower fixing device is arranged below the upper fixing device with respect to the direction of gravity.

A cleanroom in the present sense may be a barrier system, e.g., RABS (Reduced Access Barrier System), an isolator (e.g., aseptic or cytotoxic isolator), or a biosafety cabinet. A cleanroom in this sense may be pressurized to prevent or minimize the risk of contamination intrusion. Alternatively, a cleanroom in this sense can also be operated under negative pressure to prevent the escape of any toxic or otherwise hazardous substances to be handled in the cleanroom.

By means of the device, the package can be removed from the articles received therein without the need for manual intervention by an operator during the unpacking of the articles. The unpacking process can thus be automated. Glove ports in the pharmaceutical equipment and/or an isolator (with glove ports) additional to the pharmaceutical equipment for unpacking the articles can be eliminated.

The device may further comprise a guide. The guide may be arranged laterally of the stack of articles when the articles in the package are resting against the lower stop. The guide may be configured to hold the articles in their stacked arrangement (e.g., as a pile) while the articles in the package rest against the lower stop. The guide may contact the package and/or the articles laterally to hold them in their stacked arrangement while the articles rest against the lower stop.

The guide may comprise a holding device or be designed as a holding device. The holding device can be set up to fix (hold) the articles in the package when they rest against the lower stop, in particular during the removal of the cut open package. The articles can be (firmly) held by means of the holding device so that they remain in their position or location during the removal process of the cut open package, i.e. do not change their position or location.

The guide may comprise at least one shaft with an upper stop (or retaining element). In particular, the guide may comprise three shafts each having an upper stop (or retaining element) for the articles (in particular for the uppermost article of the stack of articles). The upper stop may be formed as a second stop.

The shaft may be arranged in a base plate. The base plate can be a (set-up) base for the entire device. The base plate can be arranged below the lower stop. The shaft may extend through the lower stop. For this purpose, the lower stop may have an opening through which the shaft extends. The lower stop can be coupled to the shaft, in particular rotatably.

The lower stop can be coupled or connected to the base plate by means of the shaft. The lower stop can be connected to the base plate by means of the shaft in such a way that there is a constant distance between the lower stop and the base plate (in particular in the direction of gravity). The lower stop can be arranged parallel to the base plate.

The upper stop can be designed to pivot between a fixing position and a release position.

In the fixing position, the stack of articles can be gripped (held or fixed) between the lower stop and the upper stop. The lower stop limits in particular a downward movement of the articles. The upper stop limits in particular an upward movement of the articles in the fixing position. In particular, the upper stop can be transferred to the fixing position by pivoting the upper stop towards the stack of articles. In the fixing position, the stack of articles may be arranged between the lower stop and the upper stop. In the fixing position, the stack of articles can be form-fitted gripped (held or fixed) between the lower stop and the upper stop.

In the release position, the stack of articles can be released by the upper stop. In the release position, the stack of articles can be inserted into the device from above and removed from the device. In the release position, the upper stop may be arranged such that the stack of articles is in particular not arranged between the lower stop and the upper stop. In particular, the upper stop can be transferred to the release position by pivoting the upper stop away from the stack of articles.

The upper stop can be non-rotatably connected (or coupled) to the shaft. The upper stop can be detachably connected to the shaft by means of a screw. The shaft can be designed to be rotatable. The axis of rotation of the shaft or the axis of rotation (pivot axis) of the upper stop can be oriented along the direction of gravity and, in particular, be identical to the central longitudinal axis of the shaft. In particular, the upper stop can be transferred from the release position to the fixing position and vice versa by rotating the shaft.

The upper stop can be designed as a resilient element (e.g. made of plastic). The upper stop may be formed as a resilient sheet (metal sheet). The upper stop can be arranged at a distance from the uppermost object and/or above the uppermost object of the stack of articles when these are resting against the lower stop.

The upper stop may have a beveled portion. The beveled portion of the upper stop may be located above the topmost article of the stack of articles, particularly in the fixing position. Due to the beveled portion, the package can slide more easily along the upper stop during removal by means of the removal device. This can prevent the package from getting stuck and/or tearing during removal by means of the removal device.

The lower fixing device can have two clamping jaws for clamping fixation (gripping) of the lower end of the package. The upper fixing device can have two clamping jaws for clamping fixation (gripping) of the upper end of the package. The cutting device or its knife may be arranged to cut along an edge (or along a surface) of the clamping jaws of the lower or the upper fixing device.

The device may include at least one waste container for receiving the cut open package, the upper end of the package, the lower end of the package, and/or any desiccant bag present in the package. The desiccant bag may either fall into the waste container on its own, for example due to gravity, after the package is removed from the articles. The device may comprise one or more waste containers.

The device may include a handling device (e.g., robotic arm) by means of which the cut open package, the upper end of the package, the lower end of the package, and/or the desiccant bag, if present in the package, may be conveyed into the waste container.

The device may comprise at least one optical detection device for monitoring the position and/or the location of the articles. The optical detection device may comprise a camera or be designed as a camera. The optical detection device can monitor the position and/or the location of the articles, in particular while the articles in the package are resting against the lower stop. This can, for example, detect slippage of the articles and, for example, generate and output an alarm signal (optical and/or acoustic). The device may comprise one or more optical detection devices.

The above task is further solved by a set according to the invention.

The set comprises at least one device as described above and at least one package. The package is in particular a package as described above. The package comprises an elongated stack of stacked articles.

The package may be elongated, in particular tubular. The package can have an upper (protruding) end and a lower (protruding) end. The upper end and/or the lower end of the package may each be designed to be grippable (in particular, to be clampably fixable or graspable) by means of a fixing device.

The package can be in the form of a bag or a tubular bag package, in particular tubular.

With regard to the advantages achievable with the set, reference is made to the explanations on the device in this respect. The measures described in connection with the device and/or those explained below can be used for the further design of the set.

The above task is further solved by a pharmaceutical plant, in particular by a clean room, in particular by an isolator, according to the invention.

The pharmaceutical plant comprises at least one device as described above and at least one set as described above.

With regard to the advantages achievable with the pharmaceutical plant, reference is made to the explanations concerning the device or set in this respect. The measures described in connection with the device or with the set and/or the measures explained below can serve for the further design of the pharmaceutical plant.

The pharmaceutical plant may comprise an ventilation device. The ventilation device may be arranged inside the pharmaceutical plant. It is also conceivable that the ventilation device can be arranged at least partially outside the pharmaceutical plant.

The ventilation device can be designed to generate an air flow, in particular a laminar air flow, which is directed towards the device and in particular in the direction of gravity. In other words, the, in particular laminar, air flow generated by the ventilation device can be directed onto the device from above. In this way, particles that are produced, for example, during the cutting of the package can be blown off the package so that they do not come into contact with the articles.

The above task is further solved by a method for unpacking a plurality of, in particular pre-sterilized, articles arranged in an elongated package with a upper end and a lower end stacked on top of each other in an elongated stack, within a pharmaceutical plant, in particular within a clean room, in particular within an isolator, according to the invention.

The articles may be Petri dishes or swab samples. The package may be in the form of a bag or a tubular bag package, particularly tubular. The lower end of the package may be formed as a lower flap of the package. The upper end of the package may be formed as an upper flap of the package. The upper end of the package may be a (upper) portion of the package. The lower end of the package may be a (lower) portion of the package.

The method includes the steps:

Providing at least one lower stop for the articles onto which the stack of articles in the package can be placed at one or more locations distributed around the circumference of the package.

Placing (Positioning) the stack of articles in the package against the lower stop. This can be done manually or automatically by a handling device, e.g. a robot.

Gripping (fixing), in particular clamping (gripping), the lower end of the package.

Grasping (fixing), in particular clamping (gripping), the upper end of the package.

Cutting open the package, especially cutting off the lower end or the upper end of the package.

Pulling off (removing or taking out) the cut open package from the stack of articles.

The cut open package can be pulled upwards or downwards along the direction of gravity. In other words, the cut open package can be pulled off in the direction of gravity or against the direction of gravity.

The method may further comprise the steps of:

Provide at least one upper stop for the articles.

Gripping (or holding) the stack of articles between the lower stop and the upper stop while pulling the cut open package from the stack of articles.

The method may further comprise the step of:

Decontaminating the package (from the outside), in particular by means of hydrogen peroxide (H2O2). This decontamination step can be carried out temporally, in particular, before the lower end of the package is gripped, before the upper end of the package is gripped and/or before the package is cut open.

The position and/or the location of the articles, in particular during the removal of the cut open package from the stack of articles, can be monitored. This can be implemented in particular by means of at least one optical detection device, in particular by means of at least one camera.

The method may further comprise the step of:

Placing (positioning) the cut open package, the lower end of the package, the upper end of the package and/or any desiccant bag present in the package, in particular by means of a handling device, into at least one waste container.

A device as described above, a set as described above, or a pharmaceutical plant as described above may be used to perform the method.

With regard to the advantages achievable with the method, reference is made to the explanations relating thereto concerning the device, the set or the pharmaceutical plant. The measures described in connection with the device, the set or the pharmaceutical plant and/or the measures still explained below can serve to further design the method.

BRIEF DESCRIPTION OF THE DRAWINGS

Further features, details and advantages of the invention are apparent from the wording of the claims and from the following description of embodiments based on the drawings. Showing:

DETAILED DESCRIPTION

In the following description and in the figures, the corresponding components and elements have the same reference signs. For the sake of clarity, not all reference signs are shown in all figures.

Figure 1:
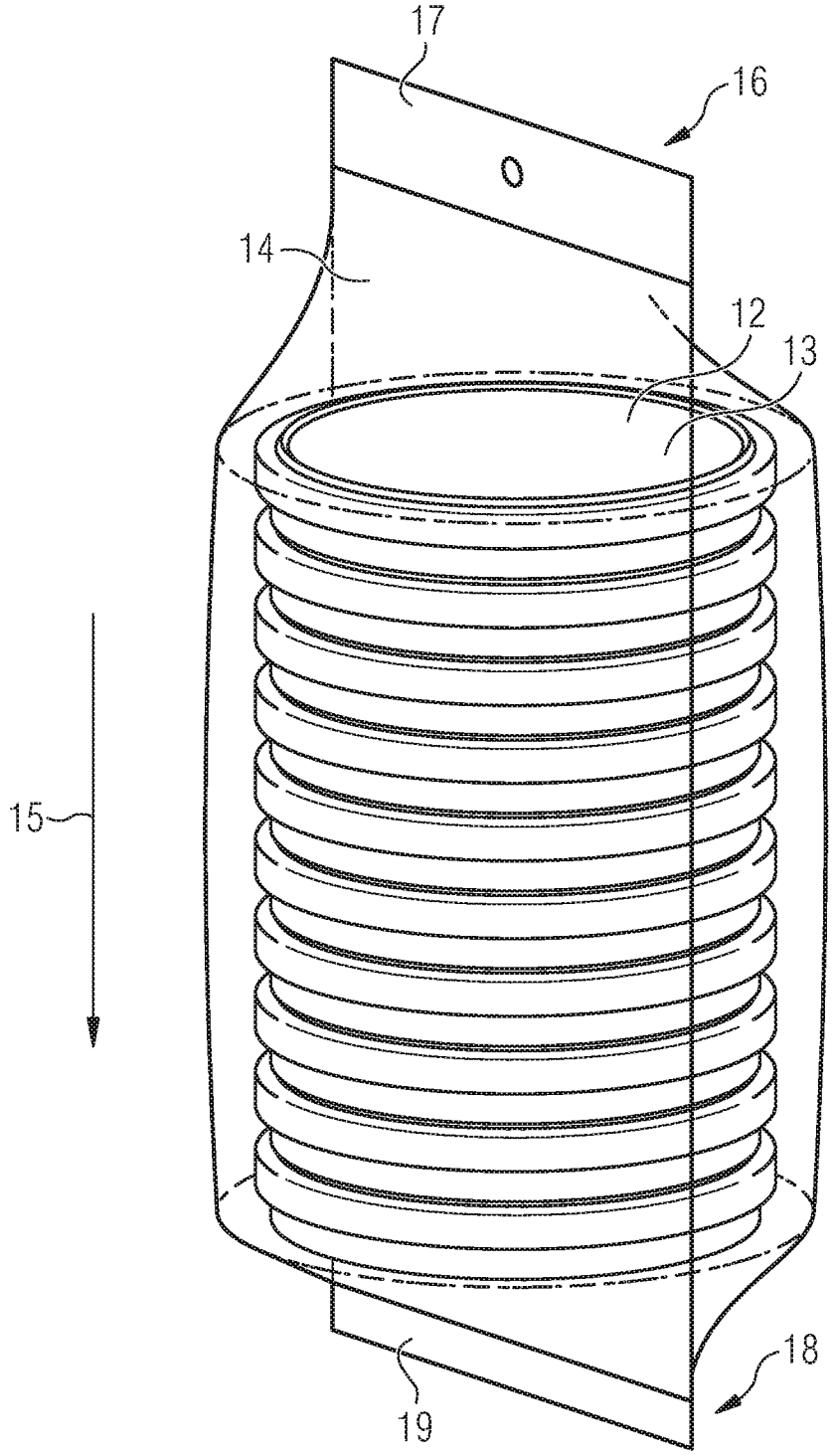
FIG. 1 a perspective view of a plurality of articles in a package.

FIG. 1 shows a perspective view of a plurality of articles 12 in a package 14. In the present case, the package 14 is designed as a tubular bag package and has an upper end 16 and a lower end 18. The upper end 16 is formed as an upper flap 17 projecting upwardly from the tubular package 14. The lower end 18 is formed as a lower flap 19 projecting downwardly from the tubular package 14.

In the present case, the articles 12 are ten Petri dishes 13 stacked on top of each other in a pile and arranged in the package 14 in a pre-sterilized state.

The terms "downward", "lower", "below" and "upward", "upper", "above" refer to gravity and the direction of gravity 15. The direction of gravity 15 is indicated by an arrow in FIGS. 1 to 4.

Figure 2:
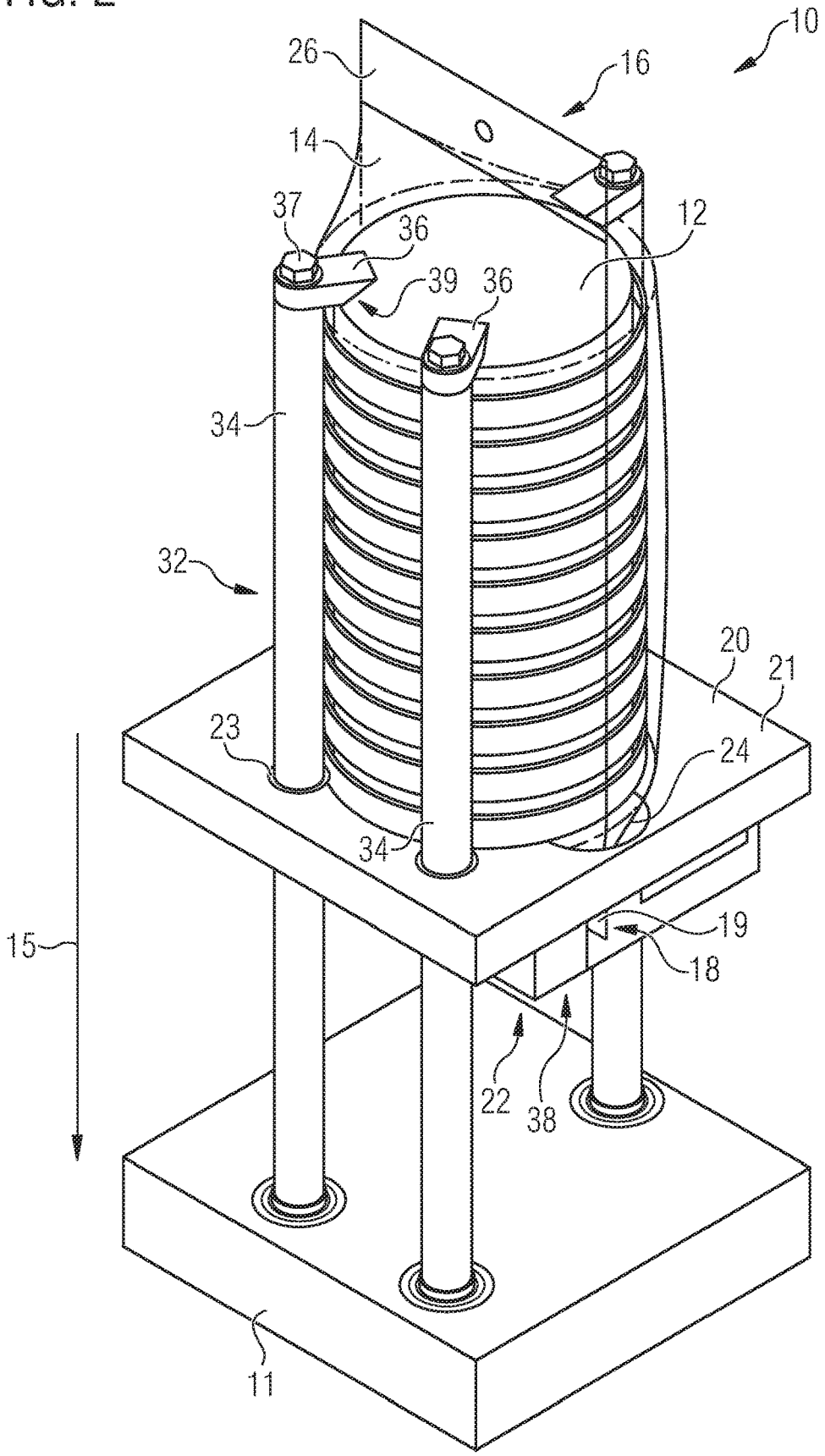
FIG. 2 a perspective view of a device.
Figure 3:
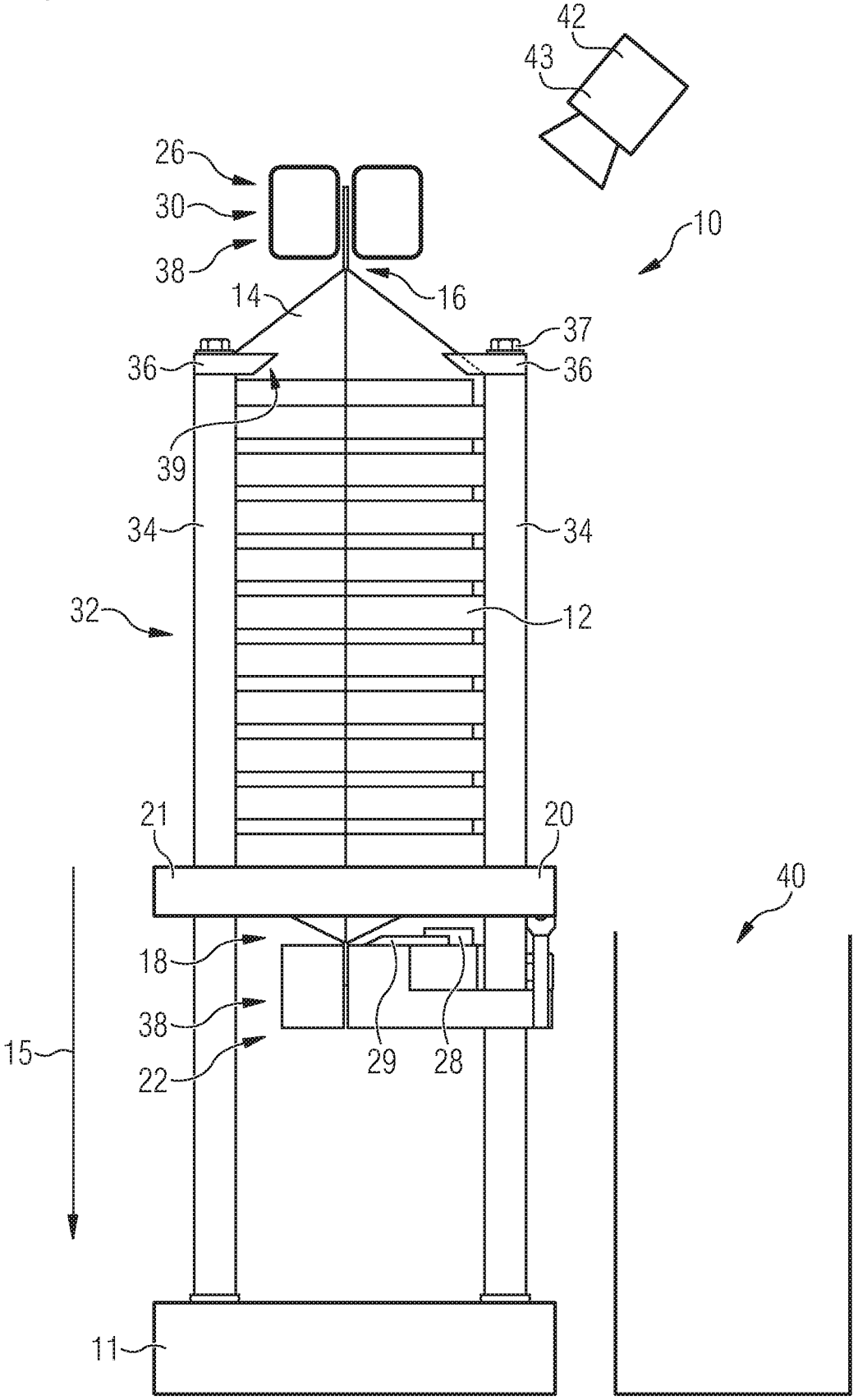
FIG. 3 a side view of the device according to FIG. 2.

FIG. 2 shows a perspective view of a device 10 and FIG. 3 shows a side view of the device 10 according to FIG. 2.

The device 10 has a base plate 11, which is used to set up the device 10. Three shafts 34 are arranged on the base plate 11, which extend vertically upwards from the base plate 11. The three shafts 34 are configured to rotate about their respective central longitudinal axes. In other words, the three shafts 34 are each rotatably coupled (connected) to the base plate 11.

The device 10 has a lower stop 20 for the articles 12. The lower stop 20 is designed in the present case in the form of a receiving plate 21. The lower stop 20 is arranged above the base plate 11.

In the present case, the three shafts 34 are each rotatably coupled (connected) to the lower stop 20. In other words, the three shafts 34 can each be rotated relative to the lower stop 20. The three shafts 34 extend through the lower stop 20. The lower stop 20 has an opening 23 (i.e. three openings 23) for this purpose.

The lower stop 20 may be coupled (connected) to the base plate 11 by means of the three shafts 34. The three shafts 34 can be rotatably mounted in the lower stop 20. This can be implemented in particular by means of bearings (not shown) arranged in the openings 23. The lower stop 20 can be firmly connected to the base plate 11 via at least one fixing element (not shown).

The three shafts 34 can extend through the lower stop 20 such that they do not contact the lower stop 20. For this purpose, the openings 23 can each have a diameter that is larger than the diameter of each of the three shafts 34.

In the presently illustrated state, the stack of articles 12 in the package 14 is placed on the lower stop 20. The lower stop 20 has a central passage 24, which in the present case is in the form of a through opening. The lower end 18 of the package 14 extends through the passage 24 to below the lower stop 20.

The device has a lower fixing device 22. The lower fixing device 22 is arranged below the lower stop 20. The lower fixing device 22 is designed for fixing the lower end 18 of the package 14, which protrudes from the passage 24 to below the lower stop 20. The lower fixing device 22 has two clamping jaws 38 for this purpose. The lower end 18 of the package 14 can thus be fixed or gripped below the lower stop 20 by means of the two clamping jaws 38 of the lower fixing device 22 by means of clamping.

The device 10 further comprises an upper fixing device 26 for gripping the upper end 16 of the package 14. For the sake of a better overview, the upper fixing device 26 is not shown in FIG. 2 and is only schematically indicated in FIG. 3.

The upper fixing device 26 is disposed above the lower stop 20. The upper fixing device 26 is designed to fix the upper end 16 of the package 14 while the articles 12 in the package 14 rest against the lower stop 20. For this purpose, the upper fixing device 26 has two clamping jaws 38, which are not shown in FIG. 2 and are only schematically indicated in FIG. 3. The upper end 16 of the package 14 can thus be fixed or gripped (above the lower stop 20) by means of the two clamping jaws 38 of the upper fixing device 26 by means of clamping.

The device 10 has a cutting device 28 for cutting the lower end 18 of the package 14 while the articles 12 in the package 14 are resting against the lower stop 20. In the present case, the cutting device 28 is designed for cutting off the lower flap 19 of the package 14 while the articles 12 in the package 14 are resting against the lower stop 20. Accordingly, the cutting device 28 is arranged between the first fixing device 22 and the lower stop 20.

The cutting device 28 has a knife 29 movable perpendicularly to the direction of gravity 15 (i.e. horizontally). The cutting device 28 or the knife 29 of the cutting device 28 is designed and arranged in such a way that the knife 29 slides along the upper edge or a surface of the two clamping jaws 38 of the lower fixing devices 22 during a cutting process. In this way, the cutting effect can be optimized or enhanced.

The upper fixing device 26 is designed as a removal device 30. For reasons of a better overview, the removal device 30 is not shown in FIG. 2 and is only schematically indicated in FIG. 3. The removal device 30 is designed to pull the package 14, which has been opened (cut open) by means of the cutting device 28, upwards (against the direction of gravity 15) from the stack of articles 12. For this purpose, the removal device 30 is designed to be movable relative to the lower stop 20, in particular along the direction of gravity 15.

The three shafts 34 extend upwardly from the base plate 11 through the lower stop 20 to above the stack of articles 12. The three shafts 34 form a guide 32 for the stack of articles 12 when they rest on the lower stop 20. The three shafts 34 can be used in particular to prevent lateral slippage (i.e. transverse to the direction of gravity 15).

Each of the three shafts 34 has an upper stop 36 at its end opposite the base plate 11. The three upper stops 36 are each (detachably) connected to the respective shaft 34 by means of a screw 37. The shafts 34 are designed to be rotatable about their respective central longitudinal axis. By rotating the respective shaft 34, the respective upper stop 36 can be pivoted transversely to the direction of gravity 15 (i.e. within a horizontal plane).

This allows the upper three stops 36 to be pivoted to a release position, in which the stack of articles 12 in the package 14 can be placed along the guide 32 onto the lower stop 20. In the release position, the top three stops 36 are directed away from the stack of articles 12.

The upper three stops 36 can be pivoted to a fixing position. The fixing position is shown in FIGS. 2 and 3. In the fixing position, the three upper stops 36 are directed toward the stack of articles 12. In the fixing position, the lower stop 20, the three upper stops 36 and the three shafts 34 form a form-fit for the stack of articles 12. The stack of articles 12 is held (fixed) between the lower stop 20 and the three upper stops 36 by means of the lower stop 20 and the three upper stops 36 when these are arranged in the fixing position.

The three shafts 34 are all the same length, such that the three upper stops 36 are disposed at the same height (within the same horizontal plane). In the present case, the three upper stops 36 are spaced from the uppermost article 12 of the stack of articles 12 in the package 14. As the package 14 is removed upwardly, the package 14 slides between the topmost article 12 of the stack of articles 12 and the three upper stops 36 due to the distance between the topmost article 12 of the stack of articles 12 and the three upper stops 36.

The three upper stops 36 each include a beveled portion 39 that is positioned above the uppermost article 12 of the stack of articles 12 in the package 14 when in the fixing position. The beveled portions 39 of the three upper stops 36 facilitate upward sliding of the package 14 during removal of the package 14.

Thus, the package 14 cut open below the lower stop 20 by means of the cutting device 28 can be pulled off (removed) upwardly from the stack of articles 12 by means of the removal device 30. In doing so, the three upper stops 36 prevent the articles 12 from being pulled along with the removed package 14 and lifted off the stack of articles 12, for example. In other words, the three upper stops 36 hold the stack of articles 12 in place on the lower stop 20.

The device 10 has a waste container 40. For sake of a better overview, the waste container 40 is not shown in FIG. 2 and is only schematically indicated in FIG. 3. The waste container 40 may serve to receive the cut open package 14, the lower end 18 of the package 14 and/or any desiccant bag (not shown) present in the package 14.

The device 10 further has an optical detection device 42, which in the present case is in the form of a camera 43. For sake of a better overview, the detection device 42 or the camera 43 is not shown in FIG. 2 and is only indicated schematically in FIG. 3.

By means of the optical detection device 42, the position or location of the stack of articles 12 can be monitored or controlled, particularly when they are resting against the lower stop 20.

Figure 4:
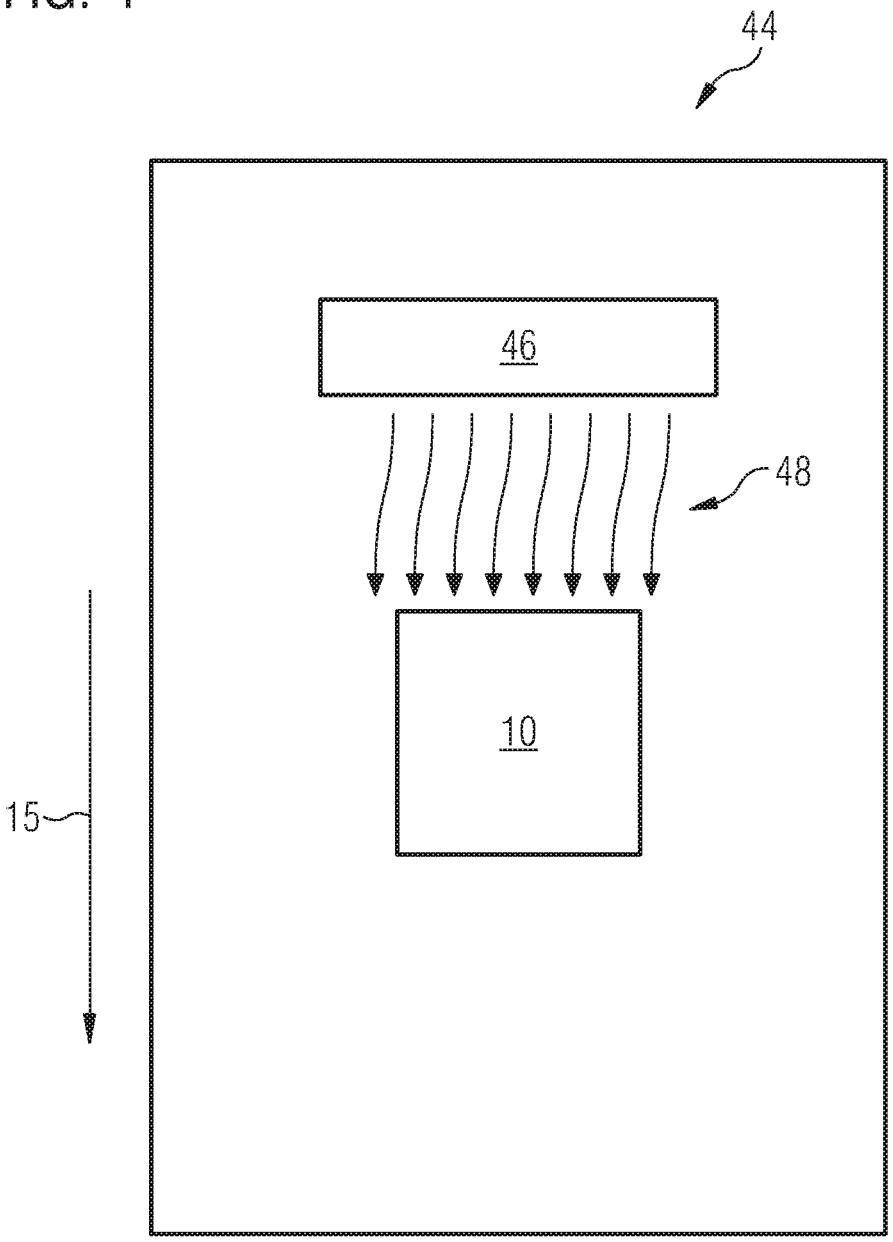
FIG. 4 a schematic side view of a pharmaceutical plant.

FIG. 4 shows a schematic side view of a pharmaceutical plant 44.

The pharmaceutical plant 44 includes the device 10 disposed within the pharmaceutical plant 44. The pharmaceutical plant 44 includes an ventilation device 46 disposed above the device 10. In the present embodiment, the ventilation device 46 is disposed within the pharmaceutical plant 44.

The ventilation device 46 is arranged to generate a laminar air flow 48. The laminar air flow 48 is schematically indicated by arrows in FIG. 4. The air flow 48 is thus directed along the direction of gravity 15 and towards the device 10.

The air flow 48 can blow off particles that may be generated during the cutting of the package 14. In this way, particles that may be generated during the cutting of the package 14 can be prevented from coming into contact with the articles 12 and thus contaminating them.

What is claimed is:

1. A device (10) for unpacking a plurality of articles (12) arranged in an elongated package (14) with an upper end (16) and a lower end (18) stacked one on top of the other in an elongated stack, within a pharmaceutical plant, said device (10) comprising:

at least one lower stop (20) for the articles (12), on which the stack of articles (12) in the package (14) can be placed at one or more locations distributed around a circumference of the package (14), at least one lower fixing device (22) arranged below the lower stop (20), the lower stop (20) having a passage (24) through which the lower end (18) of the package (14) can project to below the lower stop (20), so that the lower end (18) of the package (14) can be gripped by the lower fixing device (22) while the articles (12) in the package (14) are resting against the lower stop (20), at least one upper fixing device (26) arranged above the lower stop (20) for gripping the upper end (16) of the package (14) while the articles (12) in the package (14) are resting against the lower stop (20), at least one cutting device (28) for cutting open one of the ends (16, 18) of the package (14) while the articles (12) in the package (14) are resting against the lower stop (20), wherein while the articles (12) in the package (14) are resting against the lower stop (20), a fixing device (22, 26) of the at least one lower fixing device (22) and the at least one upper fixing device (26) that is arranged at the end (16, 18) of the package (14) opposite the cutting device (28) is configured as a removal device (30), wherein the removal device (30) is configured to pull the package (14) opened by the cutting device (28) from the stack of articles (12), wherein the articles (12) are placed on the at least one lower stop (20), and wherein the at least one lower stop (20) is configured to support a weight of the stack of the articles (12).

2. The device (10) according to claim 1, wherein the device (10) further comprises a guide (32), the guide (32) disposed laterally of the stack of articles (12) when resting against the lower stop (20), the guide (32) configured to retain the articles (12) in their stacked arrangement while the articles (12) are resting against the lower stop (20).

3. The device (10) according to claim 2, wherein the guide (32) comprises at least one shaft (34) with an upper stop (36) for the articles (12), the upper stop (36) being pivotable between a fixing position, in which the stack of articles (12) can be gripped between the lower stop (20) and the upper stop (36), and a release position in which the stack of articles (12) can be released by the upper stop (36).

4. The device (10) according to claim 3, wherein the upper stop (36) is designed as a resilient element, and/or is arranged at a distance from the uppermost article (12) of the stack of articles (12) when they rest against the lower stop (20).

5. The device (10) according to claim 3, wherein the at least one shaft (34) extends through the at least one lower stop (20).

6. The device (10) according to claim 1, wherein the lower fixing device (22) comprises two clamping jaws (38) for clampingly fixing the lower end (18) of the package (14) and/or the upper fixing device (26) comprises two clamping jaws (34) for clampingly fixing the upper end (16) of the package (14).

7. The device (10) according to claim 1, wherein the device (10) comprises at least one waste container (40) for receiving the cut open package (14), the upper end (16) of the package (14), the lower end (18) of the package (14) and/or any desiccant bag present in the package (14).

8. The device (10) according to claim 1, wherein the device (10) comprises at least one optical detection device (42) for monitoring the position and/or the location of the articles (12).

9. A set comprising at least one device (10) according to claim 1 and at least one package (14), wherein the package (14) comprises an elongated stack of stacked articles (12) within the package (14).

10. The set according to claim 9, wherein the package (14) is of elongate design, the package (14) having an upper end (16) and a lower end (18), the upper end (16) and/or the lower end (18) of the package (14) each being configured to be gripped by a fixing device (22, 26) of the at least one lower fixing device (22) and the at least one upper fixing device (26).

11. A pharmaceutical plant (44) with at least one device (10) according to claim 1.

12. The pharmaceutical plant (44) according to claim 11, wherein the pharmaceutical plant (44) comprises a ventilation device (46) which generates an air flow which is directed towards the device (10).

* * * * *